US005956771A

United States Patent [19]

Barbera

[11] Patent Number: 5,956,771

[45] Date of Patent: Sep. 28, 1999

[54] BASEBALL GLOVE AND METHOD FOR USING THE SAME

[76] Inventor: Joseph M. Barbera, 770 Duchess Ct., Vineland, N.J. 08360

[21] Appl. No.: 09/141,290

[22] Filed: Aug. 27, 1998

[51] Int. Cl.[6] ..... A41D 19/00

[52] U.S. Cl. ..... 2/161.1; 473/415

[58] Field of Search ..... 2/19, 159, 161.1; D2/616, 617, 621; D29/115; 473/415

[56] References Cited

U.S. PATENT DOCUMENTS

| | | | |
|---|---|---|---|
| 789,480 | 5/1905 | Bennett . | |
| 3,141,173 | 7/1964 | Jackson et al. | 2/19 |
| 3,994,024 | 11/1976 | Bates | 2/19 |
| 4,121,824 | 10/1978 | Hirschfield | 273/26 |
| 4,208,051 | 6/1980 | Robertson | 273/26 |
| 4,637,610 | 1/1987 | Carr | 273/26 |
| 4,802,669 | 2/1989 | Birmingham | 273/26 |
| 4,874,168 | 10/1989 | Wright | 273/26 |

*Primary Examiner*—Diana L. Oleksa
*Assistant Examiner*—Katherine Moran
*Attorney, Agent, or Firm*—Norman E. Lehrer

[57] ABSTRACT

A baseball glove including a hand covering having a palm portion, a thumb portion, four finger portions, a webbed portion extending between said thumb portion and the nearest finger portion, and a flap portion attached to the palm portion which has at least one strap for a finger to be inserted therein is disclosed. The flap portion forms a pocket with the palm portion when a finger is placed within the finger gripping means so that a baseball may be caught within the pocket. In an alternative embodiment, the baseball glove may have three finger straps.

4 Claims, 2 Drawing Sheets

BASEBALL GLOVE AND METHOD FOR USING THE SAME

BACKGROUND OF THE INVENTION

The present invention is directed toward a baseball glove and more particularly, toward a baseball glove that is particularly useful as a training aid for teaching players how to catch a ball with two hands.

A difficulty baseball coaches and instructors face when teaching young ball players is how to catch a baseball with both hands and to cover the ball immediately upon contact. A two-handed catch is preferred when fielding ground balls, line drives, and fly balls; catching a ball thrown by another player; and catching and throwing a ball in one fluid motion. Unfortunately, catching a baseball with a gloved hand together with an ungloved hand is not a natural movement for beginning players. Rather, the natural tendency is to catch a fly ball or to pick a ground ball with only the hand that is gloved. Such a practice leads to poor technique, bad habits, and ultimately, to fielding errors. Several patents have addressed this problem and several solutions have been suggested.

U.S. Pat. No. 4,121,824 to Hirschfield discloses a baseball training glove used to train a player to catch a ball with two hands. The glove has an inflexible insert which prevents a player from squeezing the glove closed around a ball. In order to catch a ball, the player must use his or her ungloved hand to trap the same. The glove described in this patent, however, does not provide the feel and grip of a typical baseball glove. Therefore, while a player may learn how to catch a ball with two hands, he or she will not grow accustomed to the flexible nature of a typical baseball glove.

U.S. Pat. No. 789,480 to Bennett discloses a baseball glove which is really two gloves hinged together. Thus, a player must use two hands in order to properly trap a ball within the glove. This glove, however, is large and cumbersome and may be awkward to use.

SUMMARY OF THE INVENTION

The present invention is designed to overcome the deficiencies of the prior art discussed above. It is an object of this invention to provide a training aid for teaching players how to catch a ball with two hands.

In accordance with the illustrative embodiments demonstrating features and advantages of the present invention, there is provided a baseball glove including a hand covering having a palm portion, a thumb portion, four finger portions, a webbed portion extending between said thumb portion and the nearest finger portion, and a flap portion attached to the palm portion which has at least one finger gripping means. The flap portion forms a pocket with the palm portion when a finger is placed within the finger gripping means so that a baseball may be caught within the pocket. In an alternative embodiment, the baseball glove may have three finger gripping means.

Other objects, features, and advantages of the invention will be readily apparent from the following detailed description of preferred embodiments thereof taken in conjunction with the drawings.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
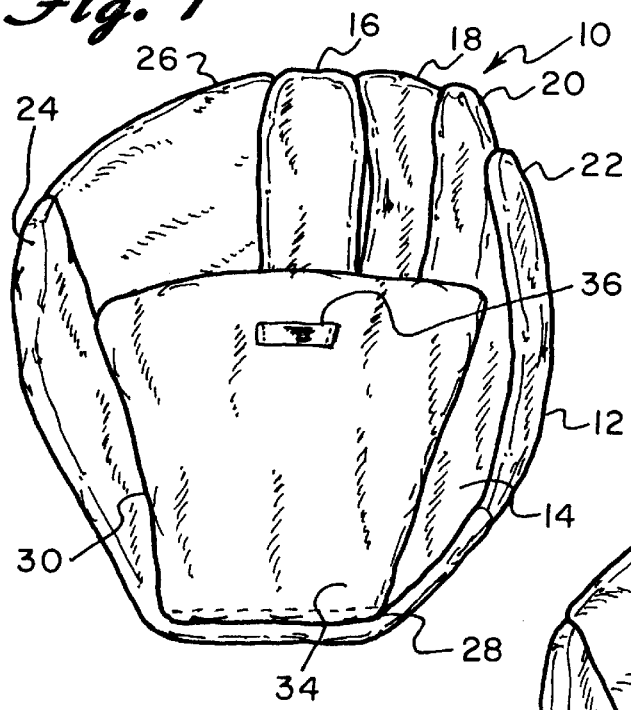
FIG. 1 is a front perspective view of the first embodiment of the baseball glove of the present invention.

Referring now to the drawings in detail wherein like reference numerals have been used throughout the various figures to designate like elements, there is shown in FIG. 1 a baseball glove constructed in accordance with the principles of the present invention and designated generally as 10.

At the outset, it should be noted that while the term "baseball" has been used, this term is broad enough to encompass both hardball and softball sports where a player uses a glove or mitt to field a ball when the ball is thrown or hit with a bat by another player.

Figure 2:
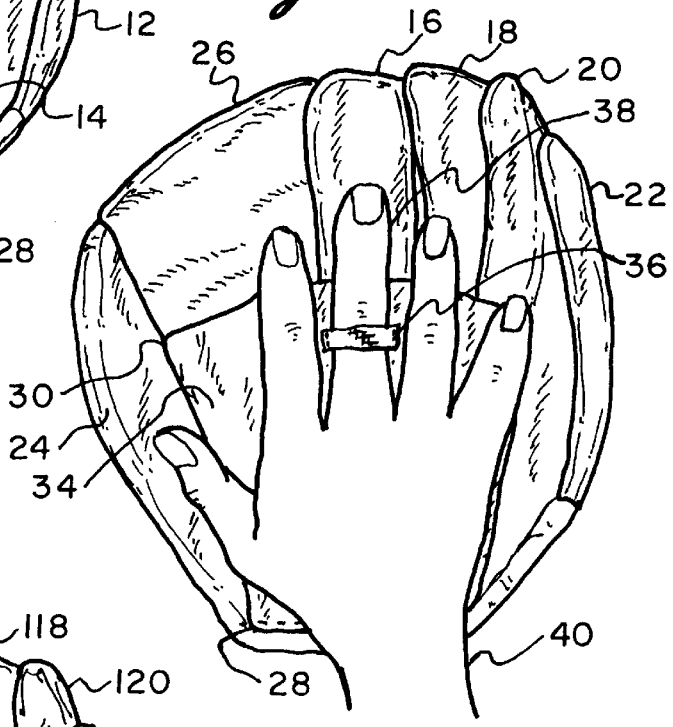
FIG. 2 is a front perspective view of the first embodiment of the baseball glove shown with a player's finger inserted through the finger gripping means.

The baseball glove 10 of the present invention includes a hand covering 12 with a palm portion 14, four finger sections 16, 18, 20, and 22, and a thumb section 24. Extending between the thumb section 24 and the nearest, or first finger section 16, is a webbed portion 26. Attached to the bottom or lower edge 28 of the palm portion 14 is a flexible flap portion 30. (See FIG. 1.) The flap portion 30 has a rear side 32 facing the palm portion 14 and a front side 34 facing away from the covering 12. The flap portion 30 may be sewn or attached to the hand covering 12 in a manner generally known in the art. The flap portion 30 is large enough to cover a substantial part of the palm portion 14. Attached on the front side 34 of the flap portion 30 is finger gripping means 36. The finger gripping means 36 is a strap which forms a loop and through which a player's finger 38, for example, may be inserted. (See FIG. 2.) In fact, the strap 36 may be of any desired length so that one or more of the player's fingers may be inserted therethrough. The strap 36 may be sewn, interwoven, or otherwise attached to the flap portion 30. Alternatively, a pocket could be formed at the top of the flap portion 30 into which the player may insert the tips of his or her fingers.

Figure 3:
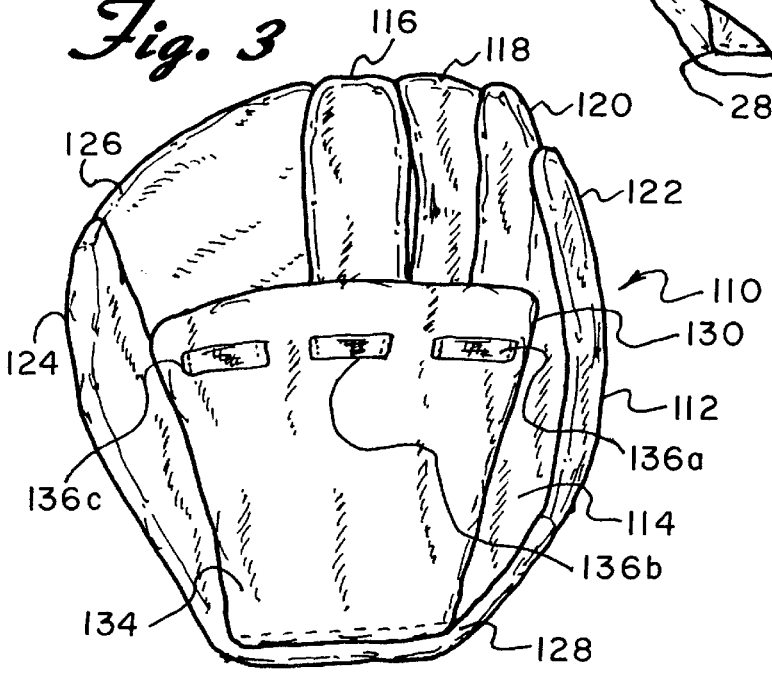
FIG. 3 is front perspective view of the second embodiment of the baseball glove shown with three finger gripping means.

In a second embodiment of the invention, as seen in FIG. 3, the glove 110 has all of the features described above regarding the first embodiment. That is, the glove 110 has a hand covering 112 with a palm portion 114, four finger sections 116, 118, 120, and 122, and a thumb section 124. Extending between the thumb section 124 and the nearest, or first finger section 116, is a webbed portion 126. Attached to the bottom or lower edge 128 of the palm portion 114 is a flexible flap portion 130. The flap portion 130 has a rear side (not shown) facing the palm portion 114 and a front side 134 facing away from the covering 112. The flap portion 130 is large enough to cover a substantial part of the palm portion 114. Attached on the front side 134 of the flap portion 130 are finger gripping means 136*a*, 136*b*, and 136*c*. In this embodiment, unlike in the first embodiment, the finger gripping means include three straps 136*a*, 136*b*, and 136*c* formed in loops and through which a player's fingers may be inserted (not shown). As in the first embodiment, the straps 136*a*, 136*b*, and 136*c* may be sewn, interwoven, or otherwise attached to the flap portion 130.

The manner in which the baseball glove of the present invention is used to train a player to catch a baseball with both hands will now be explained referring to the first embodiment. It should be noted, however, that the baseball glove of the second embodiment is used in the same manner. It should also be noted that while the present invention has been described as a training device, it would be obvious to one of ordinary skill in the art that the present invention may be used in the actual play of a game.

Figure 4:
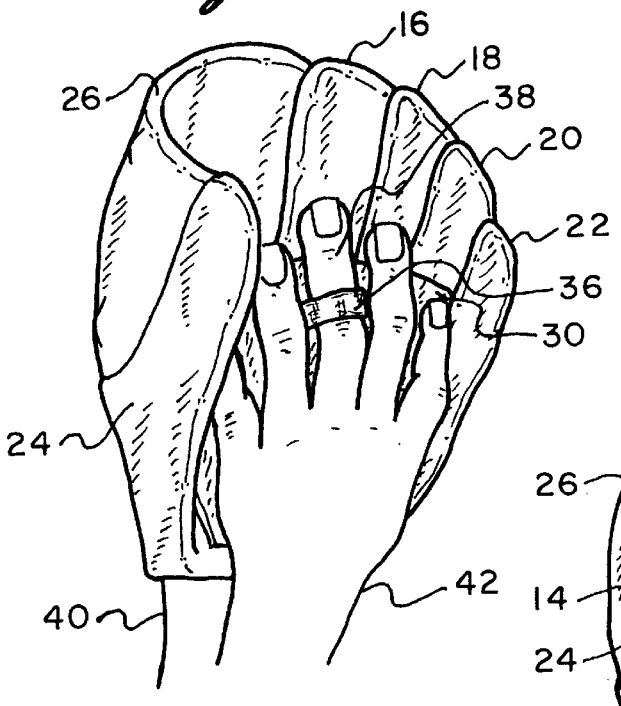
FIG. 4 illustrates the first step of the method of the present invention.
Figure 5:
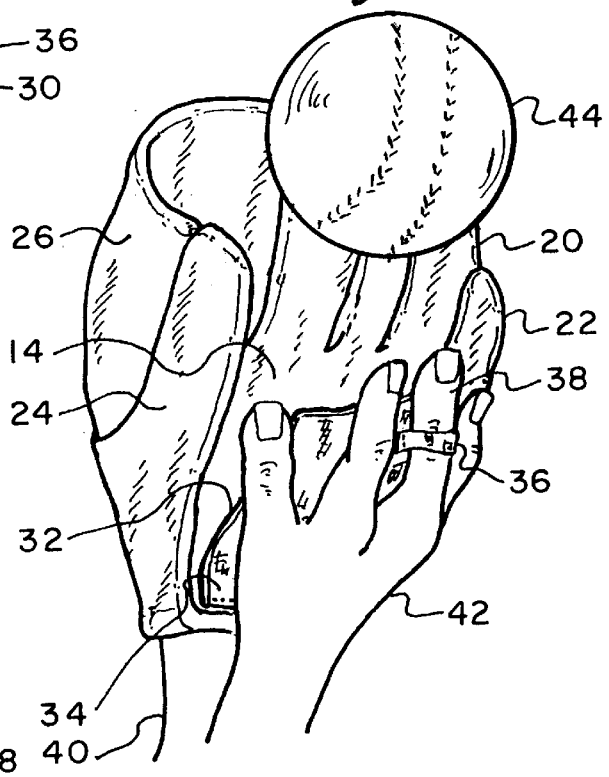
FIG. 5 illustrates the second step of the method of the present invention.
Figure 6:
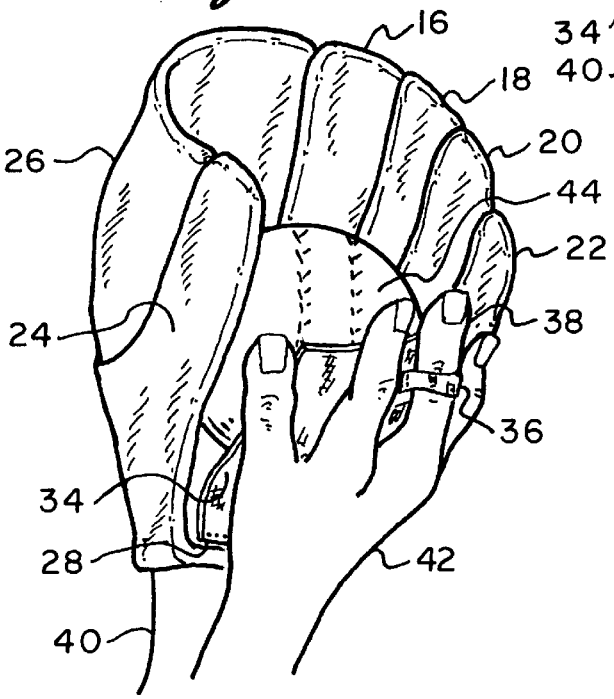
FIG. 6 illustrates the third step of the method of the present invention.

First, a player inserts his or her hand 40 into the hand covering 12. The player then preferably places his or her second finger 38 of the other hand 42 through the finger loop 36 on the flap portion 30. (See FIG. 4.) It should be realized however, that any finger or fingers may be placed through the loop. When the finger 38 is inserted through the finger loop 36, the flap portion 30 which is normally laying against the palm portion 14, is opened up, thereby forming a pocket with the palm portion 14. (See FIG. 5.) The ball 44 can now fall into the pocket that is formed. (See FIG. 6.) Thus, the player is forced to catch the ball 44 with both hands 40 and 42. That is, if the player does not use both hands 40 and 42 in order to force open the flap portion 30, the ball 44 will not fall into the palm portion 14. Rather, the ball 44 will hit the front side 34 of the flap portion 30 and will fall out of the player's hands 40 and 42. Next, once the player catches the ball 44, he or she should cover the ball 44 with the flap portion 30. In this manner, the player will learn or get into the habit of covering the ball immediately upon contact.

It should be realized that the only difference between the first and second embodiments is that instead of only one finger being inserted through a finger loop, as in the first embodiment, in the second embodiment three finger loops 136*a*, 136*b*, and 136*c* are provided so that three fingers (not shown) may be used to hold open the flap portion 130 instead of just one finger.

The glove of the present invention, including the webbed portion, flap portion, and straps, is made from leather or any other material typically used to form baseball gloves. As is typical with baseball gloves, however, the webbed portion is more flexible than the rest of the glove. Furthermore, the glove of the present invention may be made for right and left-handed players.

The flap portion of the present invention may be removably attached to the hand covering by using Velcro or other such means generally known in the art. The removability of the flap portion may be particularly beneficial when the glove is being used in an actual game rather than when the glove is being used solely for training purposes. The flap portion is also flexible and may vary in flexibility. That is, a less flexible material may be used when the glove is being used as a training device. A softer, more flexible material may be used when the glove is being used in the play of an actual game. Also, when a softer, more pliable flap portion is used, the player may bend or mold the flap portion against the palm portion of the glove, thereby forming a pocket resembling a pocket typically found in baseball gloves.

The present invention may be embodied in other specific forms without departing from the spirit or essential attributes thereof and accordingly, reference should be made to the appended claims rather than to the foregoing specification as indicating the scope of the invention.

I claim:

1. A baseball glove comprising:

a hand covering having a palm portion, a thumb portion, and four finger portions;

a webbed portion extending between said thumb portion and the nearest finger portion;

a flap portion attached to said palm portion having a rear side facing said palm portion and a front side facing away from said covering, said flap portion being large enough to cover a substantial part of said palm portion; and finger gripping means on said front side of said flap portion which includes at least one strap.

2. The baseball glove as claimed in claim 1 wherein said finger gripping means is three straps.

3. A method of training a baseball player to use two hands when catching a baseball comprising the steps of:

providing a baseball glove with a hand covering having a palm portion, a thumb portion, and four finger portions; a webbed portion extending between said thumb portion and the nearest finger portion; and a flap portion attached to said palm portion having a rear side facing said palm portion and a front side facing away from said covering, said front side having finger gripping means which includes at least one strap;

inserting one hand into said glove and inserting a finger of the other hand into said finger gripping means;

moving said flap portion away from said palm portion so that said flap portion forms a pocket with said palm portion;

catching a ball within said pocket; and covering said ball with said flap portion.

4. The method of training a baseball player to use two hands when a catching a baseball as claimed in claim 3 wherein said finger gripping means is three straps.

* * * * *